US005875803A

United States Patent [19]

Leitko et al.

[11] Patent Number: 5,875,803

[45] Date of Patent: Mar. 2, 1999

[54] JETTING PIG

[75] Inventors: Alan Dale Leitko, Houston; Gene Hugh Sherwin, Magnolia; Joe Oscar Esparza, Katy, all of Tex.

[73] Assignee: Shell Oil Company, Houston, Tex.

[21] Appl. No.: 843,907

[22] Filed: Apr. 17, 1997

[51] Int. Cl.[6] ..... B08B 9/04

[52] U.S. Cl. ..... 134/167 C; 134/168 C

[58] Field of Search ..... 134/167 C, 168 C, 134/8, 22.11, 169 C, 166 C; 239/DIG. 13

[56] References Cited

U.S. PATENT DOCUMENTS

| | | | |
|---|---|---|---|
| 3,086,540 | 4/1963 | Anderson | 134/167 C |
| 3,246,660 | 4/1966 | Hammelmann | 134/167 C |
| 4,073,302 | 2/1978 | Jones | 134/167 C |
| 4,216,910 | 8/1980 | Kimbrough | 134/168 C |
| 4,475,255 | 10/1984 | Tash | 134/167 C |
| 4,677,997 | 7/1987 | Strauss | 239/DIG. 13 |
| 4,690,159 | 9/1987 | Vadakin et al. | 134/168 C |
| 5,265,671 | 11/1993 | Vowles | 134/167 C |
| 5,389,155 | 2/1995 | Lima | 134/8 |

FOREIGN PATENT DOCUMENTS

| | | | |
|---|---|---|---|
| 252353 | 2/1970 | U.S.S.R. | 134/168 C |
| 825204 | 4/1981 | U.S.S.R. | 134/168 C |

*Primary Examiner*—Amy B. Vanatta

[57] ABSTRACT

A conduit cleaning jetting pig is provided, the pig having a central axis that can be aligned with a central axis of a conduit to be cleaned, the pig including: a seal means having an upstream side and a downstream side, the seal means effective to prevent a significant flow of fluids from the upstream side of the pig to the downstream side of the pig between the pig and the inside of the conduit when a differential pressure exists between the upstream side and the downstream side of the pig; a rotating element rotatably connected to the downstream side of the seal means; a plurality of nozzles connected to the rotating element each nozzle defining a flowpath through the nozzle for fluids to pass through each of the nozzles, and the flowpath in communication with a channel from the upstream side of the seal means to the flowpath with the flowpath through the nozzle aligned in part tangential to a cylinder around the central axis of the pig and aligned in part toward the inside wall of the conduit; and a friction creating element capable of being urged against an inside surface of a conduit, the friction creating element allowing a limited and controlled rate of movement down the pipe when fluid is provided on the upstream side of the pig wherein the friction created decreases with increasing fluid flow through the flowpaths defined by the nozzles. This pig is useful for removing solids such as wax from the inside of pipes.

5 Claims, 2 Drawing Sheets

JETTING PIG

FIELD OF INVENTION

This invention relates to a method and apparatus for removing heavy scum deposits such as petroleum wax (paraffin) from the inside of a conduit.

BACKGROUND OF THE INVENTION

Insides of long conduits such as pipelines can be difficult to clean, and yet many fluids that are advantageously transported by pipelines have a tendency to deposit solids that eventually would plug the conduit. For example, crude oils contain paraffins that may precipitate as wax and adhere to the pipe wall if the crude oil cools as it flows down a pipeline.

Mechanical cleaning devices, commonly called pigs, are often used to clean such pipelines. Pigs are generally plugs that can slide through the pipeline by the force of fluids behind the pig, removing undesirable materials by pushing these materials in front of the pig. In long pipelines, stations to launch and catch these pigs are typically provided in the pipeline. Typical pigs are not particularly effective in removing scum deposits such as wax from crude oil pipelines because solids that are removed tend to accumulate in front of the pig. These long accumulations are heavy and viscous and eventually prevent the pig from progressing further down the pipeline thus plugging the pipe. With wax deposits within a pipeline, other methods to remove the wax solids are sometimes employed. For example, the pipeline can be flushed with a solvent that dissolves the wax. This is typically very expensive because time is required for the solvent to "soak" loose the wax, the solvent is generally expensive, large volumes of solvent are often required, and the contaminated solvent is generally of considerably less value than the clean solvent.

A pipe cleaning device is suggested by Judy J. Werlink and David E. Rowell of the Kennedy Space Center that overcomes some of the disadvantages of other pipe cleaning pigs. This pipe cleaning device includes a rotating brush that is rotated by fluids passing through the pipe at a velocity greater than the velocity of the pipe cleaning device. The brush is attached to a turbine wheel, the turbine wheel effective to translate energy from the flowing fluid to rotation energy. The device must be anchored by a cable to provide that the device moves through the pipeline at a velocity sufficiently different from the fluids to result in rotation of the brush. The necessity of the cable restricts the length of pipeline that can be cleaned because of the weight of an extended length of cable. For example, a pipeline having a length of greater than about a mile would be very difficult to clean with this device. Further, a tensioner and a seal must be provided around the cable where the cable enters the pipeline. This seal provides an opportunity for pipeline contents to escape resulting in unwanted emissions.

It is desirable to have a method and apparatus that can be used to remove solids from the inside of conduits wherein extended lengths of conduit can be cleaned and wherein solids will be flushed and thus removed down the pipeline as they are removed from the wall of the conduit.

It is therefore an object of the present invention to provide a method and apparatus to remove adhered solids from the inside of a conduit wherein a cleaning device does not require a cable anchor, and wherein flow through the pig is provided to remove loose solids ahead of the movement of the pig. It is a further object to provide such an apparatus and method wherein extended lengths of conduit can be cleaned.

SUMMARY OF INVENTION

The objectives of the present invention are accomplished by providing a conduit cleaning pig having a central axis that can be aligned with a central axis of a conduit to be cleaned, the pig including: a seal means having an upstream side and a downstream side, the seal means effective to prevent a significant flow of fluids from the upstream side of the pig to the downstream side of the pig between the pig and the inside of the conduit when a differential pressure exists between the upstream side and the downstream side of the pig; a rotating element rotatably connected to the downstream side of the seal means; a plurality of nozzles connected to the rotating element each nozzle defining a flowpath through the nozzle for fluids to pass through each of the nozzles, and the flowpath in communication with a channel from the upstream side of the seal means to the flowpath with the flowpath through the nozzle aligned in part tangential to a cylinder around the central axis of the pig and aligned in part toward the inside wall of the conduit; and a friction creating element capable of being urged against an inside surface of a conduit, the friction creating element allowing a limited and controlled rate of movement down the pipe when fluid is provided on the upstream side of the pig wherein the friction created decreases with increasing fluid flow through the flowpaths defined by the nozzles. Liquid jets of the fluid transporting the pig down the conduit impinge on the conduit in front of the pig and remove deposits from the wall of the conduit. The fluid passing through the pig then transports the solids through the conduit ahead of the pig.

The means to limit movement of the pig down a conduit that is being cleaned is preferably a spring having a relaxed outside diameter that is slightly greater than the inside diameter of the conduit to be cleaned, with a first end of the spring connected to the upstream side of the sealing means. The spring is sufficiently strong and large that it will initially hold the pig in place within the conduit. Fluid pressure from the upstream side of the seal means will then pulls the downstream end of the spring forward, causing the diameter of the spring to decrease, and decrease the pressure against the inside of the conduit. As the forward end of the spring is pushed further forward by fluid pressure, the spring exerts decreasing pressure against the inside of the conduit. Eventually, a sufficient amount of the spring will have pulled away from the inside of the conduit that the rear end of the pig will slide forward, and the spring will relax, again exerting sufficient force on the inside of the conduit to hold the pig in place. Providing fluid on the upstream side of the pig therefore provides motivating force to move the pig down the conduit at a controlled rate, and provides fluid flow through nozzles of the rotating element to clean scum and solids from the inside wall of the pipe ahead of the pig.

It is a significant aspect of the present invention that sufficient fluids can pass through the pig to not only clean the inside of the conduit ahead of the pig, but to maintain movement of solids down the conduit so that solids do not accumulate ahead of the pig and eventually prevent further movement of the pig.

DESCRIPTION OF A PREFERRED EMBODIMENT

Figure 1:
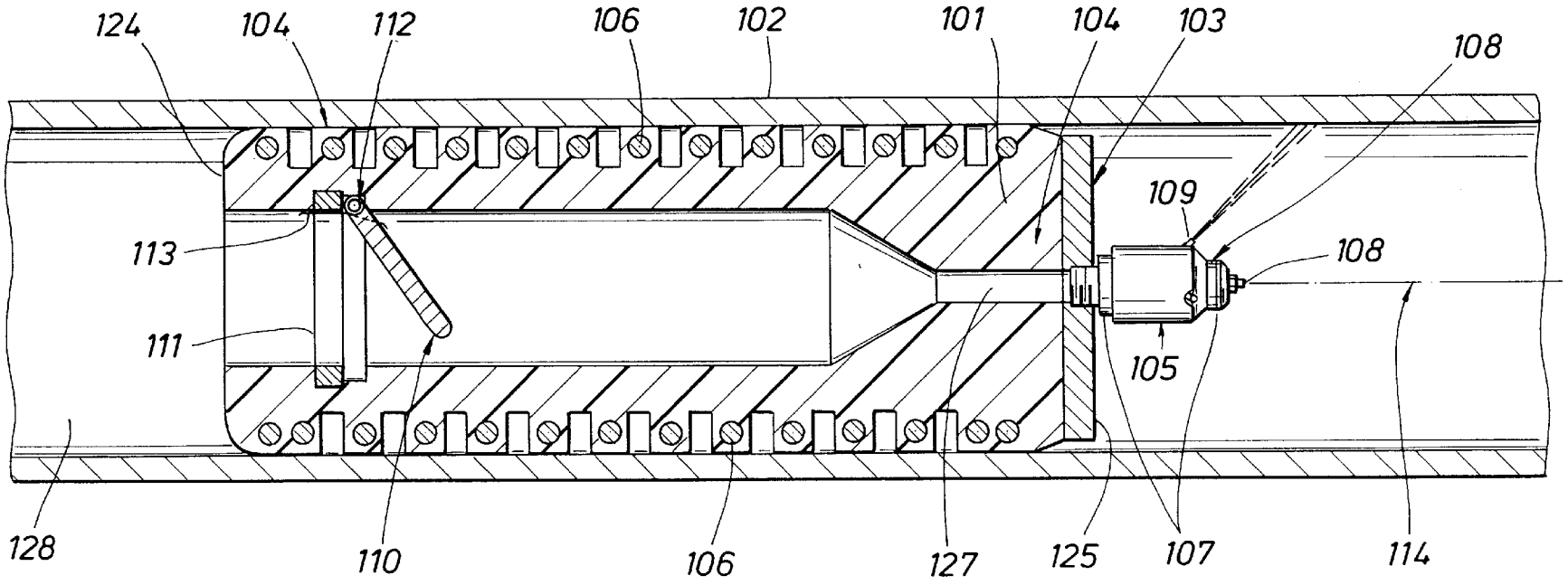
FIG. 1 shows a partial cross section of an embodiment of the present invention.

Referring now to FIG. 1, a pig 101 of the present invention is shown within a conduit 102. A rigid front plate 103 is provided to provide support for an elastomeric seal element 104, and a rotating element 105. The seal element seperates an upstream side of the seal 124 from a downstream side of the seal 125. A coil spring 106 is embedded in the elastomeric seal to provide a means to move the pig down the conduit at a controlled rate. Embedding the spring within the elastomeric seal provides for additional seal surfaces between the inside of the conduit and the outside of the pig.

The rotating element 105 further comprises nozzles 109 that are orientated with an element of a flow path through the nozzle that is tangential to a cylinder around the central axis 114 of the pig, each nozzle defining a flowpath 126 through the nozzle. Another element is directed toward the walls of a conduit to be cleaned when the pig is inside of the conduit. A plurality of nozzles is preferred, and the plurality of nozzles is preferably located symmetrically around the rotating element. Symmetrically locating the nozzles minimized vibration of the pig and minimizes forces on a spool 107 supporting the rotating element. The tangential element of the orientation of the rotating nozzles provides a force to rotate the rotating element around the spool. Rotation of the rotating nozzles improves cleaning of the inside of the conduit by jets of fluids forced through the nozzles by providing more contact on the surface of the conduit with jets of fluids. Flowpaths 126 through the nozzles provide communication between the channel 127 and downstream of the seal 125.

The rotating element 105 is mounted on a nonrotating spool 107. The nonrotating spool preferably includes a fixed nozzle 108 to provide additional fluid flow down the conduit to remove and break-up solids that have been loosened by action of the rotating nozzles 109. The fixed nozzle 108 is preferably threadably connected to the spool 107 so that it can be easily replaced if it becomes eroded, or if a different size orifice within the nozzle is desired for service cleaning different conduits or service with fluids having different properties.

The spool 107 is preferable threadably connected to the rigid front plate 103 in order to accommodate easy maintenance and fabrication, but particularly if the pig is of a larger diameter (greater than about eight inches) a flanged connection may be desirable because of increased strength.

A coil spring 106 is shown as embedded in an elastomeric seal 104 but the seal could be in front of the spring, with the spring attached to the upstream side of the seal, or the spring could be attached to the rigid front plate 103 with the seal independently surrounding the forward portion of the spring.

A check valve flap 110 prevents back flow of fluids through the pig. The check valve flap 110 is shown connected to a ring 111 connected to the elastomeric seal 104 by a hinge 112. A spring 113 can urge the flap shut so that the valve will shut regardless of the orientation of the pig in the conduit. The check valve permits the pig to be forced backwards through the conduit by reversing fluid flow. The check valve is supported upstream of a major portion of the coil spring so fluid force against the check valve flap 110 from the (normal) downstream direction will pull the coil spring to the (normal) upstream direction.

The coil spring 106 element shown in FIG. 1, by being urged against the inside of the conduit being cleaned, creates friction against the conduit, and thus tends to hold the pig in place. Fluid pressure against the upstream side of the pig will cause a portion of the coil spring near the downstream side of the pig to stretch, thus causing the diameter of the coil spring to decrease, and reduce the friction against the inside wall of the conduit. Greater flow through the restricted flowpaths will increase the difference between pressure upstream and downstream of the seal, and thus increase force stretching the coil spring. Increasing the force stretching the coil spring decreases the force the spring exerts on the inside surface of the conduit, thus increasing the rate of movement of the pig down the conduit.

The coil spring 106 is shown as a mechanism to control the rate at which fluid pressure moves the pig of the present invention down a conduit, but other mechanisms could be substituted within the scope of the present invention. For example, fluid flow through the pig could pass through a venturi, with the pressure at the venturi relative to a static pressure controlling force on a plurality of break pads urged against the inside wall of a conduit surrounding the pig. Such an arrangement is not preferred because of the complexity introduced, but such an arrangement could be provided that would allow close control over the rate at which the pig moves down the conduit.

Alternatively, a metering type positive displacement driver could be provided on the upstream portion of the pig, with an output from the motor used to control, for example, either a breaking force against the wall of a conduit, or a set of mechanisms to hold the pig in place that are slidably connected to allow the pig to walk down the inside of a pipe. The signal could be, for example, hydraulic, mechanical, or electrical. Such holding mechanisms may also be wheels that rotate at a rate controlled by a signal that varies with the rate of flow of fluid through the pig. Such arrangements could be devised by a person of ordinary skill in the art, and depending on a particular application, increasing degrees of complexity may be desirable to provide more control over the rate of movement down the conduit.

Mechanisms to control the rate of movement down a conduit that are more simple than the coiled spring shown in the attached figures are also within the scope of the present invention, so long as they provide some retardation of the movement of the pig down the conduit, thus providing a differential pressure across the pig to force flow through the fixed nozzle and rotating nozzles.

A relatively simple mechanism to control the movement of the pig down a conduit may also be provided by a mechanism that holds the pig in place for a brief time period using a break mechanism forced against the inside surface of the conduit, and releasing the break mechanism periodically for a brief time to allow movement along a short portion of the conduit.

Figure 2:
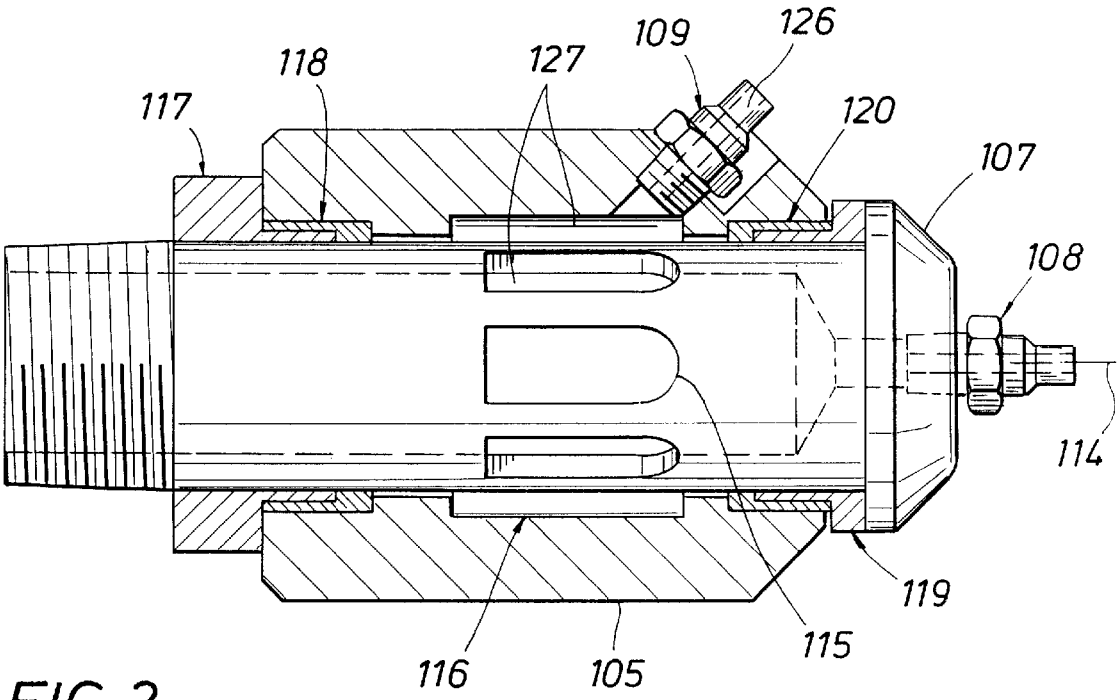
FIG. 2 shows a partial cross section of a rotating element of an embodiment of the present invention.

Referring now to FIG. 2 a cross section view of the rotating element 105 and spool 107 is shown. A rotating nozzle 109 is threadably connected to the rotating element 105. The rotating nozzle is orientated directed preferable about 45° from perpendicular to the wall of a conduit along the axis of the pig, and about 45° from the tangent of the pig to provide force for rotation of the rotating element around the spool.

The spool defines radial outlets 115 symmetrically located to provide for communication of fluids from within the spool to a radial cavity 116 that provides further communication for fluids to openings within the rotating nozzles 109. Radial outlets to the cavity 116 are preferred because such an arrangement can be provided that reduces thrust forces pressing the rotating element against the spool. Rear bearing surfaces fixed to the spool 117, and rear bearing surfaces fixed to the rotating element 118 along with front bearing surfaces fixed to the spool 119 and fixed to the rotating element 120 provide for a close and low friction fit between the rotating element and the spool. These bearings do not support a large amount of force, so a plastic material such as nylon is acceptable. The fit of the bearing surfaces limit the flow of fluids through the bearing surfaces to a flow that is significantly less than the flow through the nozzles 108 and 109. A low tolerance fit is not needed because a significant amount of fluids are passing through the pig by way of the nozzles. Fluid passing between the bearing surfaces provides cooling, cleaning and lubrication, and thus some flow of fluids between the surfaces is desirable.

Figure 3:
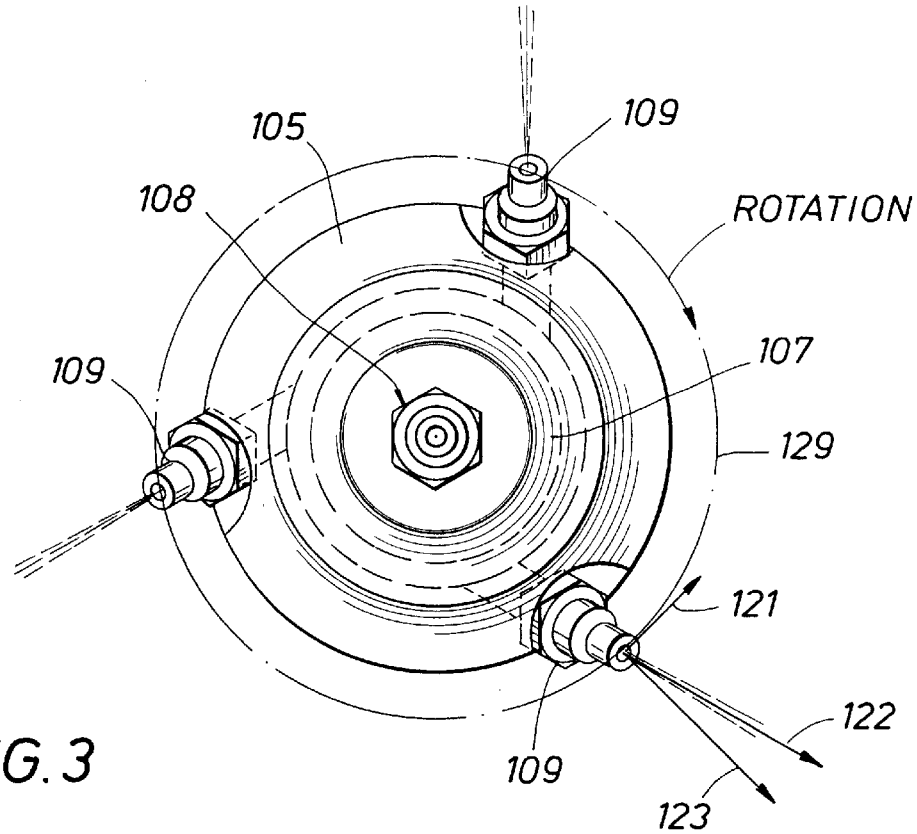
FIG. 3 shows a front view of the rotating element of an embodiment of the present invention.

Referring now to FIG. 3 a front view of the rotating element 105 and spool 107 is shown. The tangential element of the flow path of fluids passing through the rotating nozzles is shown in FIG. 3 as vector 121 of the flow path vector 122. The flowpath comprising a radial element, vector 123, that when added to the tangential element equals the total flow path vector, 122.

The pig of the present invention can be operated by placement of the pig within a conduit to be cleaned through an available pig station or an opened flange. Fluids are then passed through the conduit at a rate that results in a pressure drop through the pig of, for example, between about 50 and about 400 psi. Sizes of openings in the nozzles are chosen to result in fluid velocities of between about 50 and about 500 feet per second through the nozzles at anticipated pressure drops. Fluid streams of such velocities will contain sufficient energy to remove solids such as wax and scum from walls of a conduit. The total fluid passing through the pig in normal operation should be sufficient to provide a superficial velocity downstream of the pig high enough to result in turbulent flow downstream of the pig. Turbulent flow is generally expected to occur when the Reynolds number of the flowing fluid exceeds about $10^4$. These pressure drops will also generally be accommodated within standard size and thickness steel pipes, although rated pressures should never be exceeded within any portion of the conduit for even short time periods.

A particularly useful application for pigs according to the present invention is expected to be flow lines from subsea wellheads. These flow lines can be installed in loops with flow from a plurality of wellheads entering the loop at different points and normally flowing to a production platform through both directions from the loop. The loop can occasionally be cleaned by inserting a pig in one end at the production platform and forcing the pig through the loop by injecting fluids behind the pig until the pig returns to the platform from the other end of the loop. These flow loops could collect significant amounts of wax because they will run along the sea floor at very low temperatures, and removal of waxy material from the crude oil at a subsea wellhead would be very expensive. Expansion of gasses within the crude oil may also contribute significantly to cooling of the flowing crude oil.

The embodiments of the present invention described above are exemplary, and reference to the following claims should be made to determine the scope of the present invention.

We claim:

1. A conduit cleaning pig having a central axis that can be aligned with a central axis of a conduit to be cleaned, the pig comprising:

a seal means having an upstream side and a downstream side, the seal means effective to prevent a significant flow of fluids from the upstream side of the pig to the downstream side of the pig between the pig and the inside of the conduit when a differential pressure exists between the upstream side and the downstream side of the pig;

a rotating element rotatably connected to the downstream side of the seal means;

a plurality of nozzles connected to the rotating element each nozzle defining a flowpath through the nozzle for fluids to pass through each of the nozzles, and the flowpath in communication with a channel from the upstream side of the seal means to the flowpath with the flowpath through the nozzle aligned in part tangential to a cylinder around the central axis of the pig and aligned in part toward the inside wall of the conduit; and a friction creating element capable of being urged against an inside surface of a conduit, the friction creating element allowing a limited and controlled rate of movement down the conduit when fluid is provided on the upstream side of the pig wherein the friction created decreases with increasing fluid flow through the flowpaths defined by the nozzles.

2. The pig of claim 1 wherein the friction creating element for limiting the rate the pig moves down the conduit comprises a coil spring having a relaxed outside diameter slightly larger than the inner diameter of the conduit, the coil spring effective to engage an inner surface of the conduit to be cleaned to provide friction against the inner surface of the conduit to be cleaned and wherein fluid pressure applied to the pig causes the coil spring to stretch and gradually disengage from the inner surface of the conduit to be cleaned until the pig can slip down the pipe.

3. The pig of claim 2 wherein the coil spring is encased in an elastomeric material.

4. The pig of claim 1 wherein the rotating element rotates around a nonrotating spool, and the channel is fluidly connected to the inside of the nonrotating spool, and communication is provided radially from inside the nonrotating spool to a radial cavity defined by the rotating element.

5. The pig of claim 1 further comprising a check valve within the channel to prevent significant fluid back flow through the channel when fluid pressure is applied from the downstream side of the pig.

* * * * *